United States Patent [19]

Ernst

[11] Patent Number: 4,506,973

[45] Date of Patent: Mar. 26, 1985

[54] TONER CONCENTRATION MONITORING APPARATUS LOCATED BEHIND A TRANSPARENT PHOTOCONDUCTOR

[75] Inventor: William L. Ernst, Webster, N.Y.

[73] Assignee: Eastman Kodak Company, Rochester, N.Y.

[21] Appl. No.: 506,094

[22] Filed: Jun. 20, 1983

[51] Int. Cl.[3] ..... G03G 15/08

[52] U.S. Cl. ..... 355/3 DD; 355/14 D; 222/DIG. 1

[58] Field of Search ..... 355/3 DD, 14 D, 14 R; 222/57, DIG. 1; 118/657, 658, 694, 7

[56] References Cited

U.S. PATENT DOCUMENTS

| | | | |
|---|---|---|---|
| 3,610,205 | 10/1971 | Rarey et al. | 222/57 X |
| 3,756,192 | 9/1973 | Locklar et al. | 222/DIG. 1 X |
| 3,830,401 | 8/1974 | Benwood et al. | 222/57 |
| 3,876,106 | 4/1975 | Powell et al. | 222/57 |
| 3,926,145 | 12/1975 | Muth | 118/7 |
| 4,141,645 | 2/1979 | Reid et al. | 355/3 DD |
| 4,155,638 | 5/1979 | Blitzer | 355/3 DD |
| 4,197,813 | 4/1980 | Yano et al. | 118/694 |
| 4,377,338 | 3/1983 | Ernst | 355/14 D |
| 4,408,871 | 10/1983 | Kojima | 355/14 R |
| 4,416,535 | 11/1983 | Tottori | 355/14 D |
| 4,423,948 | 1/1984 | Kimura et al. | 355/14 D |

OTHER PUBLICATIONS

IBM Technical Disclosure Bulletin, Apr. 1979, vol. 21, No. 11.

IBM Technical Disclosure Bulletin, Sep. 1977, vol. 20, No. 4.

*Primary Examiner*—A. C. Prescott

*Attorney, Agent, or Firm*—G. Herman Childress

[57] ABSTRACT

A copier/duplicator has transparent photoconductor with a first surface on which a latent electrostatic image is formed. The latent image is developed by toner particles applied as the photoconductor is moved through a development station. A toner concentration monitor includes an emitting element and a detector. The emitting element directs a beam of radiation through the photoconductor from a second surface thereof toward an area of the development station where a developer mixture including toner particles is being provided to the first surface of the photoconductor. The detector is located adjacent the second surface of the photoconductor to receive rays emitted by the element and reflected from the developer mixture through the transparent photoconductor.

4 Claims, 2 Drawing Figures

TONER CONCENTRATION MONITORING APPARATUS LOCATED BEHIND A TRANSPARENT PHOTOCONDUCTOR

BACKGROUND OF THE INVENTION

This invention relates to toner monitoring apparatus for an electrographic copier/duplicator having a transparent photoconductor for receiving latent images to be developed by toner particles of a developer mixture. More specifically, the invention relates to the positioning of the toner monitoring apparatus so that a beam of radiation used for monitoring toner concentration passes through the photoconductor and the photoconductor shields the monitoring apparatus from contact with the developer material.

It is well known in the art to provide toner concentration monitoring apparatus which monitors the concentration of toner particles in a developer mixture containing toner and carrier particles. The toner monitor apparatus may comprise a light emitting diode that directs a beam of light in the infrared portion of the spectrum through a window in the housing of the developer station and onto a portion of the developer mixture in the station. Light rays reflected from the mixture pass back through the window and are detected by a detector. The reflectivity of the developer mixture depends upon the relative proportions of toner particles and carrier particles in the mixture. The detector is coupled to a control circuit for a toner replenisher so that additional toner particles are provided to the developer station when concentration of toner in the developer mixture reaches a predetermined level. Apparatus of this general type is disclosed in commonly assigned U.S. Pat. No. 4,141,645 which issued on Feb. 27, 1979, in the names of M. G. Reid et al.

Monitoring systems of the type described above have been satisfactory in operation. However, there are certain problems associated with prior systems. For example, sometimes dusting of developer material on the sensor or airborn dust in the developer station adversely influence the accuracy of the monitoring apparatus. Also, prior systems may monitor the developer mixture by directing electromagnetic rays through a window in a housing of magnetic brush developer station and onto developer nap on a rotating developer roller. The rays may be in the infrared portion of the spectrum and frequently are referred to as "light" rays. The light rays typically are directed at a portion of the nap moving between a developer sump in the housing and the photoconductor. Thus such systems are sensitive to the direction of rotation of nap on the roller. Also, the area of the nap struck by light rays of the monitoring apparatus is alternately rough and smooth due to the relative movement of developer material and magnets used to transport the developer material from the sump to the photoconductor. As a result, the monitoring apparatus varies as a function of the rate of movement of the developer roller (and thus the nap). Moreover, the need to provide a window through which light rays are transmitted to and from the developer roller requires the window to be positively sealed in the housing of the developer station. If the window is not adequately sealed, or if the seal deteriorates after a period of time, toner particles can pass around the window through the leaky seal and contaminate the copier/duplicator. The toner concentration monitoring apparatus of the present invention avoids these problems.

SUMMARY OF THE INVENTION

The toner concentration monitoring apparatus of the present invention is used with electrophotographic apparatus comprising a transparent photoconductor having a first surface on which a latent electrostatic image is formed, and a second surface opposite therefrom. The electrophotographic apparatus further comprises a developer station for providing a developer mixture including toner particles to the first surface of the photoconductor for development of the latent image. The improved monitoring apparatus of this invention comprises an emitting element located to direct a beam of radiation through the photoconductor from the second surface to the first surface and toward an area of the developer station where developer is provided to the first surface of the photoconductor. A detector located adjacent the second side of the photoconductor receives radiation emitted by the element and reflected from developer at the first surface of the photoconductor.

BRIEF DESCRIPTION OF THE DRAWINGS

In the detailed description of the preferred embodiment of the invention presented below, reference is made to the accompanying drawings in which.

DETAILED DESCRIPTION OF THE PREFERRED EMBODIMENT

Figure 1:
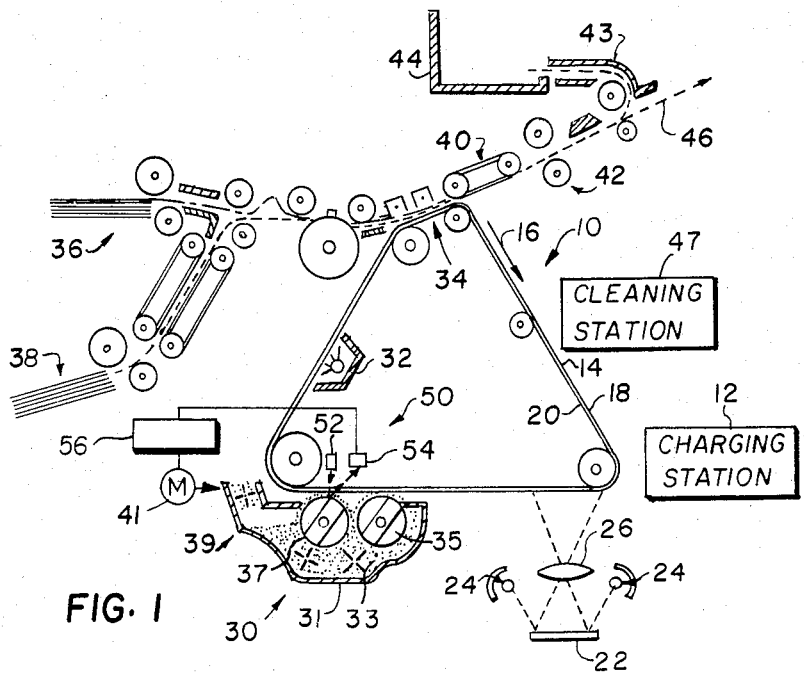
FIG. 1 is a schematic vertical section of an electrophotographic apparatus including a toner concentration monitoring apparatus of the present invention.

To assist in understanding the present invention, an electrophotographic copier/duplicator in which the invention may be used will be briefly described. It will be understood, however, that the apparatus of the present invention can be used in other types of apparatus.

Referring now to the drawings in detail, an electrophotographic apparatus generally designated 10 includes a charging station 12 which is effective to apply a uniform charge on a transparent photoconductor 14. The photoconductor is an endless web trained about a plurality of rollers and driven in the direction indicated by the arrow 16. Photoconductor 14 has a first surface 18 on the exterior of the web and a second surface 20 on the inside or backside of the web. The web may comprise a layer of photoconductive material at or adjacent to surface 18 and a conductive backing or support layer.

Figure 2:
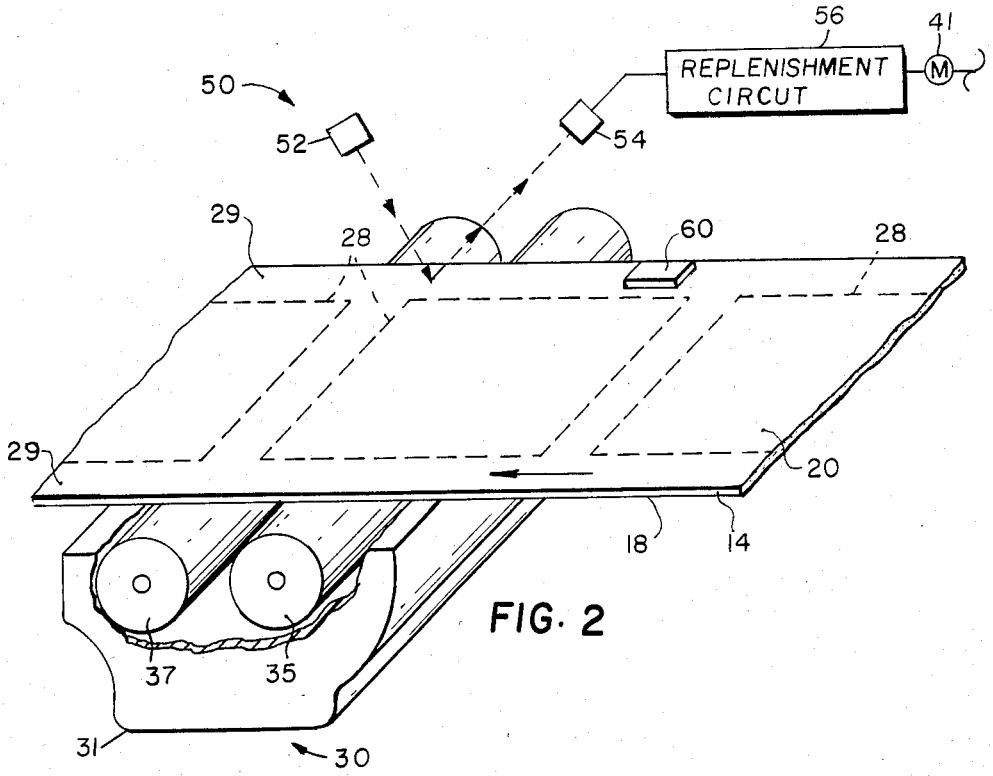
FIG. 2 is an enlarged fragmentary perspective of a portion of the apparatus illustrated in FIG. 1.

An information medium 22, such as a document to be copied, is illuminated by radiation from flash lamps 24, and the radiation is reflected from the document and projected by a lens 26 onto the surface 18 of the photoconductor. The radiation striking the charged photoconductor selectively dissipates portions of the charge to form an electrostatic latent image on the photoconductor. As shown in FIG. 2, the photoconductor has a plurality of image areas or film frames 28 that are spaced slightly from each other along the length of the web and are also spaced from the side edges of the web. Thus an elongate non-image area 29 is provided along each side edge portion of the web. The areas 28 and the spaces between the image areas can be discharged by flash and erase lamps in a conventional manner.

Apparatus 10 further comprises a magnetic brush development station generally designated 30. The development station 30 comprises a housing 31 forming a reservoir that receives a supply of developer material 33 comprising, for example, toner particles and carrier particles. One or more magnetic development brushes are provided for transferring toner particles to the latent image, two such brushes 35 and 37 being illustrated in the drawings. Station 30 also includes a toner replenisher 39 which is adapted to furnish new toner to the reservoir beneath the brushes when a motor 41 is driven.

As the latent image of document 22 on the photoconductor 14 passes through the development station, the latent image is developed by toner particles from the development station. The developed image then travels past a development erase lamp 32 located at the back side 20 of the photoconductor. Lamp 32 is effective to reduce photoconductor electrical fatigue.

The toned image then travels through a transfer station 34 where it is transferred to a copy sheet of paper. The copy sheets are fed from a selected one of two paper supplies 36 or 38. The copy sheet with the toned image thereon is then delivered by a vacuum transport 40 to a fusing station 42 where the toner on the sheet is fused to the sheet by heat and pressure. The copy sheet then is delivered either along a path 43 leading to a tray 44 or along a path 46 leading to another tray, a finishing apparatus, etc. After the web passes through transfer station 34 it is cleaned in a cleaning station 47 and is available for another cycle of operation.

Electrophotographic apparatus as generally described hereinbefore is disclosed in more detail in the before-mentioned U.S. Pat. No. 4,141,645. Reference is made to such patent for a more complete description of the apparatus and its operation.

The toner concentration monitoring apparatus of the present invention is generally designated 50 and comprises a radiation emitting element 52 and a detector 54 both of which are located adjacent the back side or inner surface 20 of the photoconductor. Preferably, element 52 is capable of emitting electromagnetic rays in the infrared portion of the spectrum. As noted before, such rays are frequently referred to as "light" rays even though they are not in the visible portion of the spectrum. Detector 54 is responsive to the wave length of rays from element 52, and the photoconductor is relatively transparent to rays from element 52. Element 52 is located relative to the photoconductor 14 to direct a beam of rays through the transparent photoconductor from the backside 20 to the front side 18 thereof and then onto the nap of developer on brush 37 (or brush 35). Preferably the element 52 is positioned and directed toward the area of the nap on brush 37 (or brush 35) between the brush and the photoconductor and underlying the non-image area 29 of the photoconductor. Thus rays from the element 52 are directed toward the nap through undevelopable (not charged, or charged but then erased) portions of the photoconductor area. In this manner resulting rays are reflected off of a representative sample of the developer material on the developer brush that is available to tone latent images on the photoconductor instead of those portions the developer nap on brush 37 (or brush 35) which have been depleted of toner by transfer of the toner to the latent image. Moreover, the rays from element 52 do not adversely affect the quality of the image reproduced by discharging the image areas 28 of the photoconductor.

The detector is located relative to the emitting element 52 and other portions of the apparatus so that it receives rays emitted by element 52 and reflected through photoconductor 14 from developer particles in the nap of brush 37 (or brush 35) just under the first surface of the photoconductor and in the non-image areas 29. As disclosed in U.S. Pat. No. 4,141,645, detector 54 is coupled to a replenishment circuit 56 which monitors the signal produced by the emitting element 52 and detector 54. Circuit 56 is coupled to motor 41 of the toner replenisher 39 so that when the toner concentration monitored by the apparatus of the invention reaches a predetermined level, the motor is energized to supply additional toner to the development station 30.

The nap between the developer brushes and the photoconductor is flattened because the spacing between the brushes and photoconductor is less than the thickness of the developer nap transported to the photoconductor by the brushes. Flattening of the nap reduces the alternate pattern of rough and smooth areas normally found in other areas of the nap on the rollers. By directing the light rays from element 52 at this flattened area, the monitoring apparatus should be less sensitive to the rate and direction of rotation of the developer rollers than prior systems which direct light rays at the nap between the developer reservoir and the photoconductor.

Element 52 and detector 54 can be positioned at the backside 20 of the photoconductor because the photoconductor is transparent to rays emitted by element 52. In order to insure a high degree of accuracy, at least a portion of the back surface 20 of the photoconductor can be cleaned to make certain that the portion of the photoconductor through which the rays from the emitter 52 travel is free of contamination. Such can be accomplished by providing a cleaning pad 60 (FIG. 2) that is adapted to contact and wipe clean the surface 20 of the photoconductor. Pad 60 is located relative to the element 52 and detector 54 so that it is effective to clean that portion of the photoconductor through which the beam of rays passes from element 52 to the detector 54. Thus cleaning pad 60 is located upstream from the point where the beam of rays from element 52 travels through the photoconductor and is in line with the portion 29 of the photoconductor outside the image area 28. If desired, the entire back surface 20 of the photoconductor can be cleaned instead of just that portion aligned with the non-image areas.

Because the emitting element and detector are located adjacent to the surface 20 of the photoconductor, they can be positioned to allow measurement and control of toner concentration at any position across the development station 30. Thus the toner concentration can be measured at any of the development brushes 35, 37, and at either the front or rear portions thereof, or at both the front and rear portions thereof.

A number of advantages result from the apparatus of the present invention. For example, the apparatus of the present invention is insensitive to toner dusting inside development station 30 as occurs with some prior apparatus. Moreover, the development station frequently has some air-born dust particles within the housing 31 that may adversely affect prior monitoring apparatus which require rays from the emitter element to pass through such dust particles. The present apparatus looks directly at the nap on the developer brush without the rays passing through such dust particles and thus is not sensitive to the level of dust within the development station 30. In addition, the apparatus of the present invention should not be affected by either the direction of rotation of brushes 35, 37 or by the rate at which such brushes are being rotated during operation because it monitors the nap directly between the brush and the photoconductor.

A further advantage of the present apparatus is that it completely eliminates the need for a window in the housing 31 of the development station as required for some prior monitoring apparatus which used the window to transmit rays from the emitter to the inside of housing 31 and then back to the detector of the monitoring system. Elimination of such a window avoids problems associated with contamination of the inner surface of the window which adversely affects the accuracy of the control system. In addition, such windows must be tightly sealed in order to avoid contamination of the apparatus by toner particles leaking around the window. The present invention eliminates the problems associated with such a window.

At the same time, the photoconductor shields the element 52 and detector 54 from airborne particles in the developer station.

The invention has been described in detail with particular reference to a preferred embodiment thereof, but it will be understood that variation and modifications can be effected within the spirit and scope of the invention.

We claim:

1. In electrographic apparatus comprising a transparent photoconductor having a first surface on which a latent electrostatic image is formed and a second surface, the apparatus further comprising a development station for providing a developer mixture including toner particles to the first surface of the photoconductor for development of the latent image, the improvement comprising:

toner concentration monitoring apparatus comprising an emitting element located to direct a beam of radiation through the photoconductor from the second surface to the first surface and toward an area of the development station where developer mixture is provided to the first surface of the photoconductor, and a detector located adjacent the second side of the photoconductor for receiving radiation emitted by the element and reflected from developer mixture at the first surface of the photoconductor.

2. The invention as set forth in claim 1 wherein the photoconductor has a first area in which the latent image is formed and a second area outside the first area, and wherein the emitting element is located relative to the photoconductor to project radiation through the second area of the photoconductor and the detector is located relative to the photoconductor to receive radiation reflected through the second area.

3. The invention as set forth in claim 2 further comprising means for cleaning contaminants from at least the portion of the second surface of the photoconductor through which radiation is directed from the emitting element and is reflected to the detector.

4. In an electrographic apparatus having a development station for applying developer comprising a mixture of carrier and toner particles to a photoconductor bearing an electrostatic images and means for adding toner particles to the developer to replenish the toner particles depleted during image development, an improved toner concentration monitor comprising:

a source of electromagnetic radiation of a wavelength to which the photoconductor is relatively transparent and detecting means for sensing intensity levels of such radiation, said source being positioned to direct such radiation through the photoconductor toward the developer and said detecting means being positioned to sense the intensity level of such radiation reflected by the developer through the photoconductor, whereby the source and detection means are shielded from contact with the developer by the photoconductor; and means responsive to the levels of radiation sensed by said detecting means for causing said toner adding means to replenish the toner particles in the developer.

* * * * *